US007461598B2

(12) United States Patent
Shiwaku

(10) Patent No.: US 7,461,598 B2
(45) Date of Patent: Dec. 9, 2008

(54) OVERHEAD TRAVELING VEHICLE SYSTEM

(75) Inventor: Tamotsu Shiwaku, Kani (JP)

(73) Assignee: Murata Kikai Kabushiki Kaisha, Kyoto-shi (JP)

( * ) Notice: Subject to any disclaimer, the term of this patent is extended or adjusted under 35 U.S.C. 154(b) by 276 days.

(21) Appl. No.: 11/401,886

(22) Filed: Apr. 12, 2006

(65) Prior Publication Data

US 2006/0230975 A1 Oct. 19, 2006

(30) Foreign Application Priority Data

Apr. 14, 2005 (JP) ..... 2005-116474

(51) Int. Cl.
*B61J 3/00* (2006.01)
*B61B 15/00* (2006.01)

(52) U.S. Cl. ..... 104/88.01; 104/87

(58) Field of Classification Search ..... 104/88.01, 104/87; 701/200
See application file for complete search history.

(56) References Cited

U.S. PATENT DOCUMENTS 6,721,627 B2 * 4/2004 Udou et al. ..... 700/228
2005/0159854 A1 * 7/2005 Hori et al. ..... 701/1
2005/0171656 A1 * 8/2005 Hori et al. ..... 701/19
2006/0016363 A1 * 1/2006 Nakao et al. ..... 104/88.01
2006/0051188 A1 * 3/2006 Hoshino ..... 414/277
2006/0051192 A1 * 3/2006 Fujiki ..... 414/626
2006/0182553 A1 * 8/2006 Yamamoto ..... 414/278
2006/0222479 A1 * 10/2006 Shiwaku et al. ..... 414/267
2006/0230975 A1 * 10/2006 Shiwaku ..... 104/88.01
2006/0271252 A1 * 11/2006 Hori et al. ..... 701/23
2007/0027615 A1 * 2/2007 Nagasawa ..... 701/200
2007/0163461 A1 * 7/2007 Shiwaku ..... 104/89

FOREIGN PATENT DOCUMENTS

JP 6-19548 1/1994
JP 06019548 A * 1/1994

* cited by examiner

*Primary Examiner*—S. Joseph Morano
*Assistant Examiner*—Jason C Smith
(74) *Attorney, Agent, or Firm*—Westerman, Hattori, Daniels & Adrian, LLP.

(57) ABSTRACT

A loop-shaped maintenance bay route 6 directly connected to an inter-bay route 4 is provided for the maintenance of an overhead traveling vehicle 8. An operation check traveling line 16 and an operation check station 18 are provided along the maintenance bay route 6 for fully carrying out tests for traveling operation and transfer operation of the overhead traveling vehicle 8. In an adjustment/repair area 14, adjustment, configuration, repair, reconfiguration, or the like of the overhead traveling vehicle 8 are performed.

17 Claims, 4 Drawing Sheets

50

OVERHEAD TRAVELING VEHICLE SYSTEM

TECHNICAL FIELD

The present invention relates to an overhead traveling vehicle system. In particular, the present invention relates to the maintenance of an overhead traveling vehicle.

BACKGROUND ART

The overhead traveling vehicle system is used for transporting articles utilizing an overhead space in a clean room or the like. As the increase in the scale of semiconductor factories or the like, the scale of the overhead traveling vehicle systems have been increased. As a result, some systems utilize, e.g., 100 or more overhead traveling vehicles. In order to smoothly operate the large scale system, it is important to fully carry out the maintenance of the overhead traveling vehicles, and minimize differences between the overhead traveling vehicles. In the conventional systems, though it is known that a lifter for elevating and lowering the overhead traveling vehicle is provided in part of the traveling route for carrying out the maintenance of the overhead traveling vehicle on the ground, it cannot be said that the importance of the maintenance has been considered sufficiently.

SUMMARY OF THE INVENTION

An object of the present invention is to make it easier to carry out the maintenance of an overhead traveling vehicle, and make it possible to move the overhead traveling vehicle between a route for carrying out the maintenance and an inter-bay route.

A secondary object of the present invention is to make it possible to reintroduce the overhead traveling vehicle after operations of traveling means and transfer means of the overhead traveling vehicles are fully checked.

A secondary object of the present invention is to place redundant overhead traveling vehicles on standby so that the redundant overhead traveling vehicles can be reintroduced into the inter-bay route promptly.

According to the present invention, an overhead traveling vehicle system includes an inter-bay route and a plurality of intra-bay routes branched from, i.e., connected to the inter-bay route. Each of the inter-bay route and the intra-bay routes comprises a traveling rail. The system further includes a maintenance bay route, comprising a traveling rail and used for the maintenance of an overhead traveling vehicle. An entrance and an exit of the maintenance bay route are directly connected to the inter-bay route without passing through the intra-bay routes.

It is preferable that no semiconductor processing apparatuses or the like are provided on the maintenance bay route, and the maintenance bay route is used for the maintenance only. The entrance and the exit of the maintenance bay route are directly connected to the inter-bay route, and the maintenance bay route is a loop-shaped traveling route.

It is preferable that a loop-shaped traveling line for allowing the overhead traveling vehicle to travel around the traveling line to check traveling operation of the overhead traveling vehicle, and a station for allowing the overhead traveling vehicle to transfer an article to/from the station to check operation of transfer means in the overhead traveling vehicle are provided along the maintenance bay route. It is particularly preferable that a station for checking traveling operation of the overhead traveling vehicle is provided along the loop-shaped traveling line.

Further, it is preferable that a standby area for accommodating a redundant overhead traveling vehicle from the inter-bay route, and placing the redundant overhead traveling vehicle on standby is provided along the maintenance bay route.

It is preferable that a lifter having a traveling rail, which is connectable to the traveling rail of the maintenance bay route and is able to be elevated and lowered, is further provided, and when the traveling rail of the lifter is moved to an upper position, the traveling rail of the lifter is connected to the traveling rail of the maintenance bay route, and when the traveling rail of the lifter is moved to a lower position, the traveling rail of the lifter is connected to a traveling rail fixed on the ground or a movable traveling rail. In the structure, the overhead traveling vehicle travels from the traveling rail of the maintenance bay route to the traveling rail of the lifter. Then, when the lifter is moved downwardly, the overhead traveling vehicle can move to a rail fixed on the ground or the movable rail such as a rail of a maintenance wagon according to an embodiment as described later.

Further, it is preferable that means for storing a history file which records maintenance history for each overhead traveling vehicle, and means for instructing the overhead traveling vehicle to travel to the maintenance bay route based on the recorded maintenance history are further provided. It is preferable that, in addition to the maintenance file, operation condition history or trouble history for each overhead traveling vehicle is recorded in the history file. In consideration with the operation condition history together with the maintenance history, the overhead traveling vehicle is made travel to the maintenance bay route. In this manner, the maintenance of the overhead traveling vehicle can be carried out systematically.

According to the present invention, the entrance and the exit of the maintenance bay route are directly connected to the inter-bay route. Therefore, the overhead traveling vehicle can be transferred easily between the maintenance bay-route and the inter-bay route. Further, since the maintenance bay route for the maintenance is provided, adjustment, configuration, repair of the overhead traveling vehicle can be carried out on the maintenance bay route. Thus, the maintenance operation becomes easy.

In the case where a loop-shaped traveling line for allowing the overhead traveling vehicle to travel around the loop-shaped line to check traveling operation of the overhead traveling vehicle is provided, after the maintenance, the overhead traveling vehicle travels around the loop-shaped traveling line for a sufficient period of time on a test, and then, the overhead traveling vehicle is reintroduced into the inter-bay route so that the overhead traveling vehicle can be used actually. Therefore, in the system, the hidden cause of troubles or incomplete maintenance, if any, can be eliminated reliably. Further, the overhead traveling vehicle can be reintroduced into the inter-bay route after operation of the transfer means of the overhead traveling vehicle is checked at the operation check station.

In the case where the standby area for accommodating the redundant overhead traveling vehicle from the inter-bay route is provided, and the overhead traveling vehicle can be placed on standby in the standby area, when an additional overhead traveling vehicle is requested, the redundant overhead traveling vehicle can be reintroduced through the inter-bay route, and can be immediately and actually used. The standby period of the overhead traveling vehicle can be utilized, e.g., for the maintenance of the overhead traveling vehicle.

Brief Description of the Symbols

Figure 1:
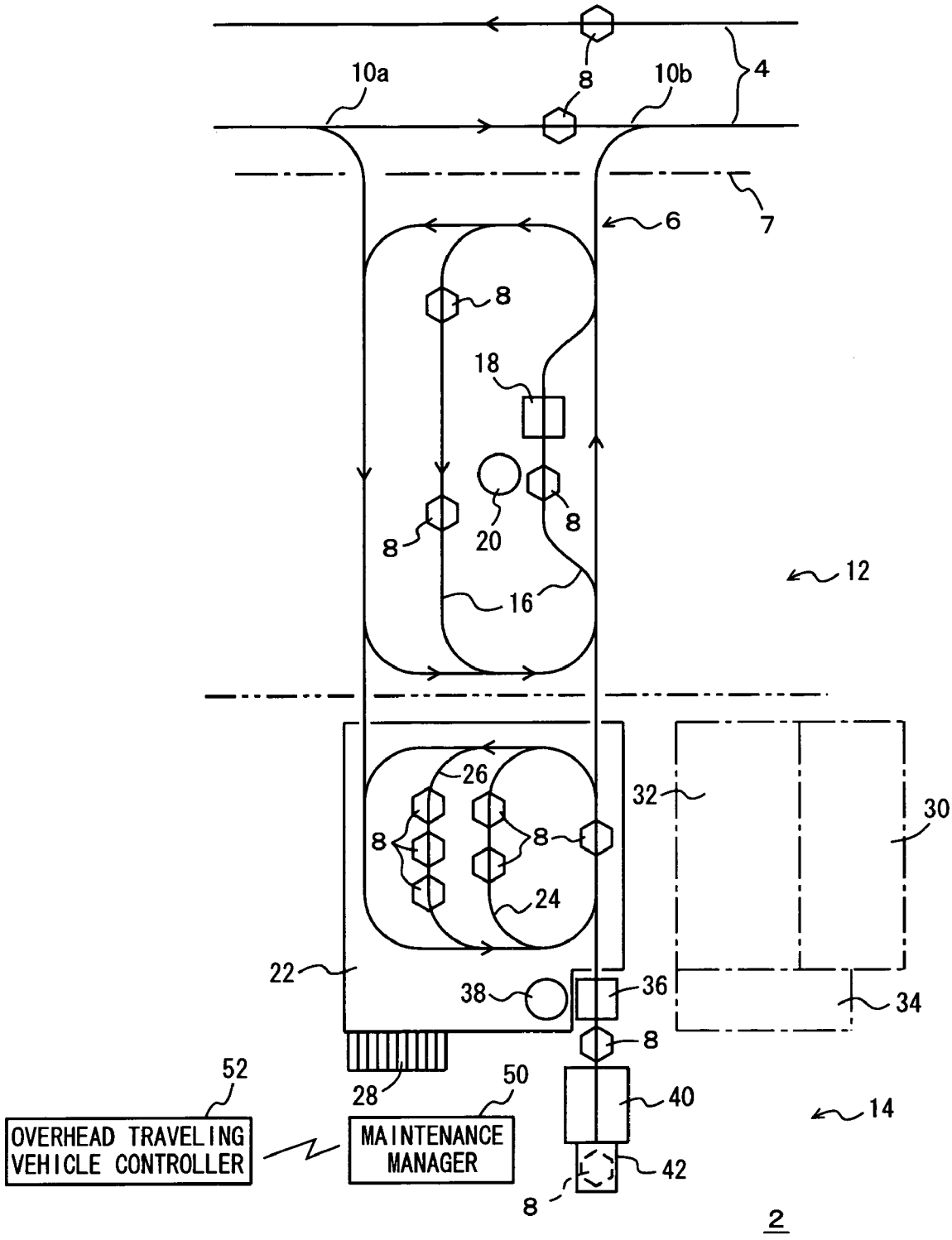
FIG. 1 is a view showing a maintenance bay in an overhead traveling vehicle system according to an embodiment.

| | | | |
|---|---|---|---|
| 2 | Overhead traveling vehicle system | 4 | Inter-bay route |
| 6 | Maintenance bay route | 7 | Border |
| 8 | Overhead traveling vehicles | 10a, b | Entrance and Exit |
| 12 | Operation check area | 14 | Adjustment/repair area |
| 16 | Operation check traveling line | 18 | Operation check station |
| 20 | Operation check buffer | 22 | Counter |
| 24 | Adjustment/repair line | 26 | Storage line |
| 28 | Stair | 30 | Adjustment/repair area |
| 32 | Storage area | 34 | Parts area |
| 36 | Base station | 38 | Base buffer |
| 40 | Lifter | 42 | Maintenance wagon |
| 50 | Maintenance manager | | |
| 52 | Overhead traveling vehicle controller | | |
| 54 | Traveling rail | 56 | Traveling cart |
| 58 | Body frame | 60 | Lateral feeding unit |
| 62 | θ drive | 64 | Elevation drive unit |
| 66 | Hoisting frame | 68 | Fall prevention cover |
| 70 | Teaching apparatus | 72 | Kinematic pin |
| 74 | Elevating and lowering unit | 76 | Elevating rail |
| 80 | Monitor | 82 | Keyboard |
| 84 | Inter-controller communication unit | | |
| 86 | Overhead traveling vehicle communication unit | | |
| 88 | Printer | | |
| 90 | Overhead traveling vehicle history file | | |
| 92 | Traveling command issuing unit | | |
| 94 | Adjustment/repair procedure instruction unit | | |

EMBODIMENT

Hereinafter, an embodiment in the most preferred form for carrying out the present invention will be described.

An overhead traveling vehicle system 2 according to the embodiment will be described with reference to FIGS. 1 to 4. The overhead traveling vehicle system 2 is provided in a semiconductor factory or the like. A reference numeral 4 denotes an inter-bay route. A plurality of intra-bay routes (not shown) corresponding to bays of semiconductor devices are connected to the inter-bay route 4. For example, the number of overhead traveling vehicles 8 in the overhead traveling vehicle system 2 is 100 or more in total. The total length of traveling routes is about several thousand meters. If a trouble occurs in any of the overhead traveling vehicles 8 in the inter-bay route or the intra-bay route, production efficiency for semiconductors is lowered.

A loop-shaped maintenance bay route 6 is provided. The maintenance bay route 6 protrudes from the inter-bay route 4 like a peninsula. A reference numeral 7 denotes a border between the inter-bay route 4 and the maintenance bay route 6. The reference numerals 8 denote the overhead traveling vehicle. The maintenance bay route 6 is directly connected to the inter-bay route 4 at an entrance 10*a* and an exit 10*b*. The maintenance bay route 6 has a bay shape. In principle, equipment or machines, which are not related to maintenance, such as semiconductor processing apparatuses or stockers are not provided on the maintenance bay route 6. The maintenance bay route 6 is used for the maintenance only. The maintenance bay route 6 includes two areas, i.e., an operation check area 12 and an adjustment/repair area 14. The operation check area 12 includes a loop-shaped operation check traveling line 16 for allowing the overhead traveling vehicle 8 to travel along the loop of the operation check traveling line 16. Further, the operation check area 12 includes an operation check station 18 provided along the line 16, and an operation check buffer 20. After the maintenance of the overhead traveling vehicle 8 in the adjustment/repair area 14 is finished, the overhead traveling vehicle 8 travels along the operation check traveling line 16, for example, for about 24 hours for checking operation. During the period, articles are transferred repeatedly between the operation check station 18 and the operation check buffer 20. Further, while the overhead traveling vehicle 8 is traveling along the operation check traveling line 16, communication functions of the overhead traveling vehicle 8 and operation of sensors or the like are checked. Some troubles of the overhead traveling vehicle 8 occur intermittently, and these troubles may not be detected easily. However, it is likely that such troubles can be detected if the overhead traveling vehicle 8 travels along the operation check traveling line 16 and repeatedly transfers articles for, e.g., 10 hours or more.

In the adjustment/repair area 14, for example, adjustment, configuration, repair, and reconfiguration after repair of the overhead traveling vehicle 8 are carried out. A reference numeral 22 denotes a counter. On the counter 22, the operator can easily carry out the maintenance operation for the overhead traveling vehicle 8 on the route provided near the ceiling of a clean room. An adjustment/repair line 24 is provided on the counter 22 for allowing the operator to adjust, repair, and configure the overhead traveling vehicle 8, for example. A storage line 26 can accommodate redundant overhead traveling vehicles from the inter-bay route 4. The redundant overhead traveling vehicles are placed on standby as spares on the storage line 26. The storage line 26 is used for both of standby of the redundant (spare) overhead traveling vehicles, and transfer of the overhead traveling vehicles into/from the adjustment/repair line 24. Further, another storage line may be provided in the operation check area 12. A reference numeral 28 denotes stairs of the counter 22. Structure of a floor under the counter 22 is shown on the lower right side in FIG. 1. A reference numeral 30 denotes an adjustment/repair area for repairing and adjusting the overhead traveling vehicle. A reference numeral 32 denotes a storage area. Overhead traveling vehicles that cannot be repaired or adjusted immediately, or redundant overhead traveling vehicles that are not scheduled to be reintroduced into the inter-bay route 4 for the time being are stored in the storage area 32. A parts area 34 stores, e.g., repair parts or tools that are required in the maintenance bay route 6.

A base station 36 and a base buffer 38 are provided in the adjustment/repair area 14 for adjusting transfer means of the overhead traveling vehicle 8. A reference numeral 40 denotes a lifter for elevating and lowering the overhead traveling vehicle 8 between the ground floor and the traveling rail of the maintenance bay route 6. A reference numeral 42 denotes a maintenance wagon that is manually operated for moving the overhead traveling vehicle 8 which has been moved down to the ground by the lifter 40. A reference numeral 50 denotes a maintenance manager that is embodied by a suitable computer. The maintenance manager 50 manages the maintenance of all the overhead traveling vehicles 8 in the overhead traveling vehicle system 2. A reference numeral 52 denotes an overhead traveling vehicle controller for controlling the entire overhead traveling vehicle system 2. The overhead traveling vehicle controller 52 communicates with the maintenance manager 50.

Figure 2:
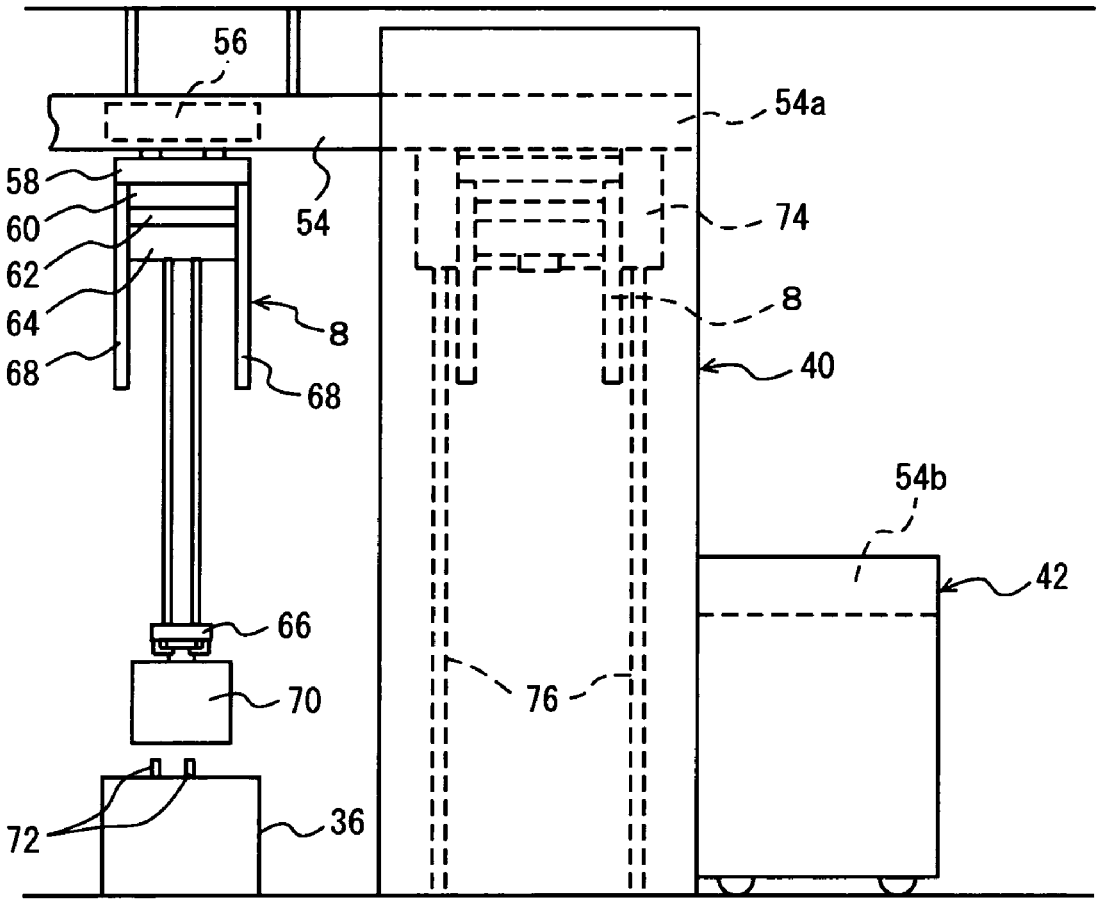
FIG. 2 is a side view schematically showing a lifter for the overhead traveling vehicle and a base station according to the embodiment.

FIG. 2 shows the base station 36 and the lifter 40. A traveling rail 54 is provided in an overhead space of the clean room. The traveling rail 54 forms the inter-bay route 4 and the maintenance bay route 6. The overhead traveling vehicle 8 includes a traveling cart 56 that travels inside the traveling rail 54, and a body frame 58. For example, on the side of the body frame 58, a lateral feeding unit 60, a θ drive 62, a elevation drive unit 64, and a hoisting frame 66 are provided. The lateral feeding unit 60 is used for laterally moving the θ drive 62, the elevation drive unit 64, and the hoisting frame 66 relative to the traveling rail 54 when an article is transferred between the buffers 20, 38 or the like in FIG. 1. The θ drive 62 rotates the elevation drive unit 64 and the hoisting frame 66 in a horizontal plane such that the article can be transferred in an orientation adapted to the station or the buffer. The elevation drive unit 64 elevates and lowers the hoisting frame 66, and holds an article (not shown) such as a semiconductor cassette with a chuck for transportation. Further, a pair of fall prevention covers 68, 68 are provided on both front and back sides of the overhead traveling vehicle 8. Among these components, the lateral feeding unit 60 and the θ drive 62 may not be provided.

For example, a teaching apparatus 70 is chucked by the hoisting frame 66 such that the teaching apparatus 70 contacts kinematic pins 72 provided on the base station 36. At this time, based on the height where the teaching apparatus 70 touches the kinematic pins 72 or the position of the kinematic pins 72 determined by the teaching apparatus 70, the position of the overhead traveling vehicle 8 relative to the base station 36 is adjusted. The overhead traveling vehicle 8 stores transfer data for transferring the article to/from the base station 36. In accordance with the data, the teaching apparatus 70 is moved downwardly, and the contact position and the contact height of the teaching apparatus 70 with the kinematic pins 72 are determined. Assuming that the stored transfer data is correct, the teaching apparatus 70 is supposed to contact the kinematic pins 72 at a predetermined height, and a predetermined position in the horizontal plane. Based on the error in the contact height and the contact position, the overhead traveling vehicle 8 adjusts the transfer data for the base station 36. For the actual station provided in the intra-bay route, for example, at a position near the station, the change amount of the transfer data from the transfer data for the base station 36 is indicated. The overhead traveling vehicle 8 reads the data using a sensor (not shown), and adds the read data to the transfer data for the base station 36 to generate the transfer data used for transferring the article to/from the individual station.

The lifter 40 includes a elevating and lowering unit 74 for elevating and lowering the overhead traveling vehicle 8 together with a traveling rail 54*a* along elevating rails 76, between the overhead space and the ground. When the maintenance wagon 42 is connected to the side surface of the lifter 40, the traveling rail 54*b* of the maintenance wagon 42 and the traveling rail 54*a* which has been moved downwardly by the elevating and lowering unit 74 are connected together. For example, it is possible to manually move the overhead traveling vehicle 8 between the lifter 40 and the maintenance wagon 42. By moving the maintenance wagon 42, the overhead traveling vehicle 8 is transferred between the adjustment/repair area 30 and the storage area 32 shown in FIG. 1.

The base station 38 shown in FIG. 1 is a base point of buffers (not shown) provided in the intra-bay route. These buffers are provided on the side of the traveling rail, or under the traveling rail, and used as temporal storages for articles. For example, if the article can be transferred to/from the base buffer 38 correctly, the article should be transferred to/from each of the buffers in the intra-bay route. Using the base buffer 38, as in the case of the base station 36 in FIG. 2, the transfer data for the buffers are adjusted.

Figure 3:
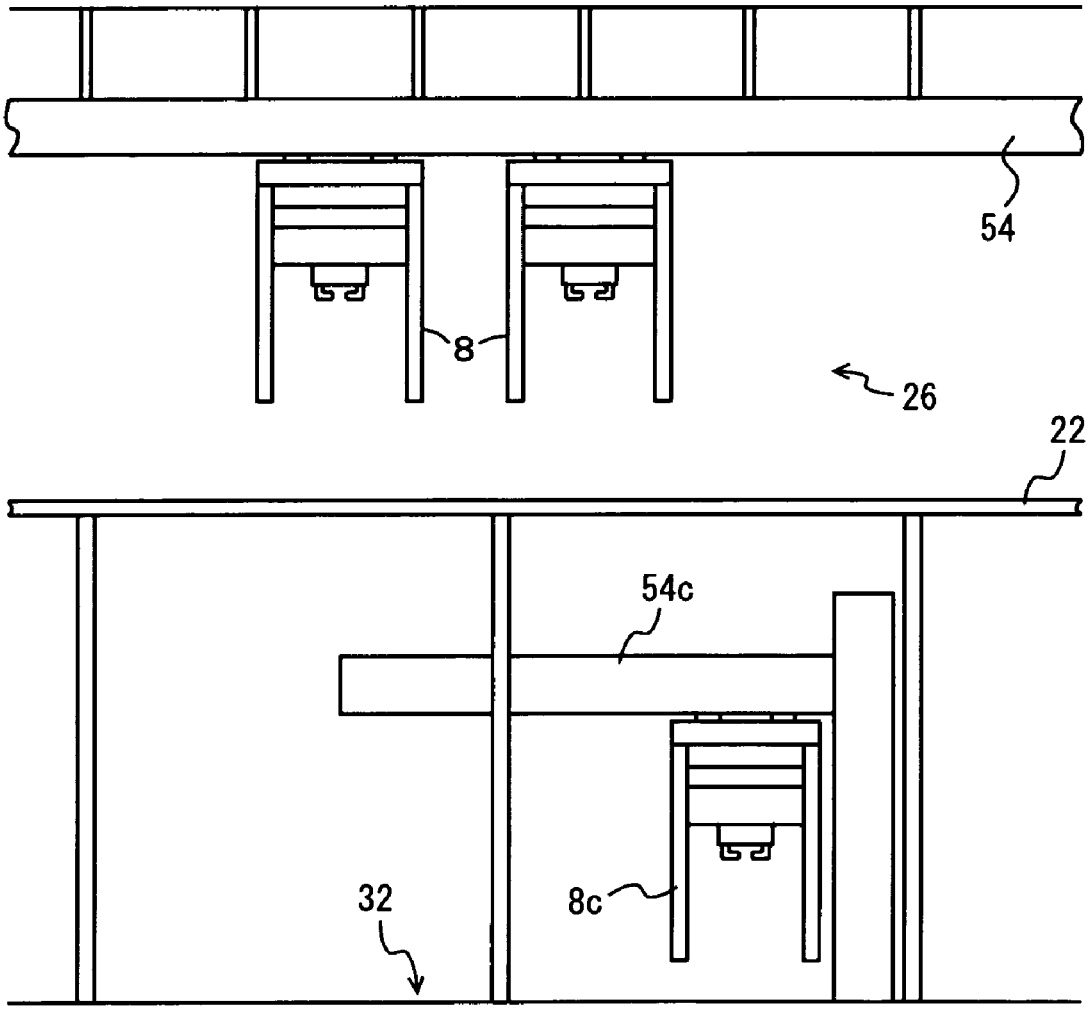
FIG. 3 is a side view showing an adjustment/repair area according to the embodiment.

FIG. 3 shows the storage line 26 and the storage area 32 in the adjustment/repair area. In the storage line 26, redundant overhead traveling vehicles 8 are stored. The redundant overhead traveling vehicles 8 are supported by the traveling rail 54. In the storage area 32, an overhead traveling vehicles 8*c* is stored. For example, the overhead traveling vehicle 8*c* is supported by a traveling rail 54*c*. At this time, the area around the traveling rail 54*c* may be closed by a cover for preventing the standby overhead traveling vehicle 8*c* making dirty. Alternatively, when the overhead traveling vehicle is stored, without using the traveling rail 54*c*, the overhead traveling vehicle may be placed in the maintenance wagon.

Figure 4:
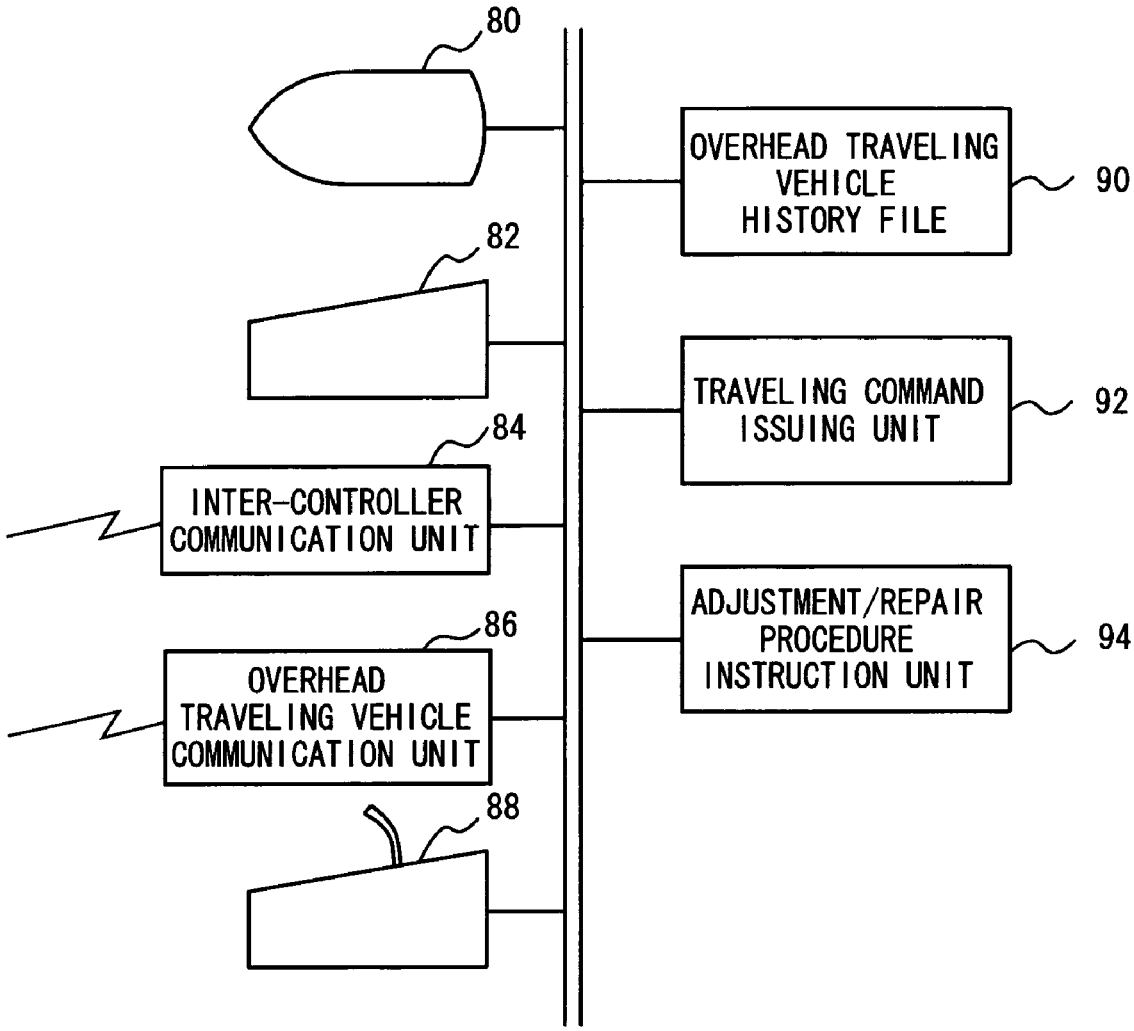
FIG. 4 is a block diagram showing a maintenance manager according to the embodiment.

FIG. 4 shows structure of the maintenance manager 50. A reference numeral 80 denotes a monitor, a reference numeral 82 denotes a keyboard, and a reference numeral 84 denotes an inter-controller communication unit. For example, the inter-controller communication unit 84 communicates with the overhead traveling vehicle controller for receiving commands such as a command for instructing the overhead traveling vehicle that needs the maintenance to travel from the overhead traveling vehicle controller side to the maintenance bay-route or a command for introducing the overhead traveling vehicle after the maintenance into the inter-bay route. From the inter-controller communication unit 84, information about the number of the overhead traveling vehicles is reported to the overhead traveling vehicle controller or the like. For example, the information includes the number of the overhead traveling vehicles in the maintenance bay route, the number of the overhead traveling vehicles which can immediately be reintroduced into the inter-bay route from the storage line 26, the number of the overhead traveling vehicles which are stored in the storage area 32 on the ground after the maintenance, and the number of the overhead traveling vehicles which are being repaired, adjusted, or which are traveling on a test. An overhead traveling vehicle communication unit 86 communicates with overhead traveling vehicles, which are supplied electricity through the traveling rail and able to establish communication, among the overhead traveling vehicles in the maintenance bay route, for providing a command to the overhead traveling vehicle to travel to the adjustment/repair line 24, the storage line 26, the base station 36, or the lifter 40, etc. in the maintenance bay route. Further, the overhead traveling vehicle communication unit 86 provides a command to the overhead traveling vehicle for instructing the overhead traveling vehicle, for example, to travel in the operation check traveling line 16, to transfer the article to/from the operation check station 18 or the operation check buffer 20, or to wait in the storage line 26. A printer 88 prints various items of data stored in the maintenance manager 50.

An overhead traveling vehicle history file 90 records historical data of individual overhead traveling vehicles. In particular, the overhead traveling vehicle history file 90 stores, for example, the total traveling time, the total number of transfers, maintenance history, or trouble history such as failures which have been experienced. A traveling command issuing unit 92 issues commands for the overhead traveling vehicles in the maintenance bay route. The commands include, for example, a traveling command for operation check traveling or the like, a command for instructing the overhead traveling vehicle to transfer the article to/from the station or the buffer, and a traveling command for instructing the overhead traveling vehicle to travel to the inter-bay route. An adjustment/repair procedure instruction unit 94 instructs the procedure of adjustment, configuration, repair, reconfiguration, or the like of the overhead traveling vehicle. Specifically, the adjustment/repair procedure instruction unit 94 outputs the procedure of operations to the monitor 80, the printer 88, or a portable information terminal or the like of the operator. Further, the maintenance manager communicates with, e.g., the manufacturer of the overhead traveling vehicle system for exchanging the schedule of dispatching the service staff, the parts replenishment schedule, and the other beneficial information for the maintenance.

Operation according to the embodiment will be described. If any trouble occurs in the overhead traveling vehicle traveling along the inter-bay route or the intra-bay route, the overhead traveling vehicle is instructed by a suitable controller to travel to the maintenance bay route. The maintenance manager stores the maintenance history of each of the overhead traveling vehicles. Therefore, in accordance with the maintenance history, a maintenance schedule is determined, and the overhead traveling vehicle travels to the maintenance bay route under the control of the overhead traveling vehicle controller. In the other case, since the number of overhead traveling vehicles required in the overhead traveling vehicle system may vary depending on the production schedule of semiconductors or the like, the redundant overhead traveling vehicles are instructed to travel to the maintenance bay route.

In the maintenance bay route, for example, the operator checks the overhead traveling vehicle in the adjustment/repair line 24, and reports the condition of the overhead traveling vehicle to the maintenance manager. The operator receives instructions for adjustment, repair, or the like, and carries out the required operation. Further, the operator adjusts the transfer data using the base station 36 and the base buffer 38. After adjustment, repair, configuration, or the like of the overhead traveling vehicle is finished, the overhead traveling vehicle continuously travels along the operation check traveling line 16 for about 24 hours, for example. During the period, the overhead traveling vehicle repeatedly transfers the article to/from the station 18 and the buffer 20. In general, after the operation is continuously performed for the period to the extent as described above, hidden defects of the overhead traveling vehicle can be detected. In the operation, if it is confirmed that there are no defects in the overhead traveling vehicle, the overhead traveling vehicle is placed on standby in the storage line 26, the storage area 32 or the like until the overhead traveling vehicle is reintroduced into the inter-bay route under the control of the overhead traveling vehicle controller.

The invention claimed is:

1. An overhead traveling vehicle system, comprising:

a fixed traveling rail comprising an inter-bay route, a plurality of intra-bay routes connected to said inter-bay route, and a maintenance bay route used for the maintenance of an overhead traveling vehicle, a lifter having an elevatable/lowerable traveling rail connectable to said fixed traveling rail, wherein when said elevatable/lowerable traveling rail of said lifter is moved to an upper position, said elevatable/lowerable traveling rail of said lifter is connected to said maintenance bay route of fixed traveling rail, and when said elevatable/lowerable traveling rail of said lifter is moved to a lower position, said elevatable/lowerable traveling rail of said lifter is connected to at least one of a ground-mounted traveling rail and a movable traveling rail, and wherein an entrance and an exit of said maintenance bay route are directly connected to said inter-bay route without passing through said intra-bay routes.

2. The overhead traveling vehicle system of claim 1, wherein said maintenance bay route further comprises an operation check area comprising a loop-shaped operation check traveling line for allowing the overhead traveling vehicle to travel around said loop-shaped operation cheek traveling line to check traveling operation of the overhead traveling vehicle, and an operation check station for allowing the overhead traveling vehicle to transfer an article to/from said operation check station to check operation of a transfer means in the overhead traveling vehicle.

3. The overhead traveling vehicle system of claim 1, wherein said maintenance bay route further comprises a standby area for accommodating a redundant overhead traveling vehicle from said inter-bay route, and for placing the redundant overhead traveling vehicle on standby.

4. The overhead traveling vehicle system of claim 1, further comprising a means for storing a history file which records maintenance history for each overhead traveling vehicle, and a means for instructing the overhead traveling vehicle to travel to said maintenance bay route based on the recorded maintenance history.

5. The overhead traveling vehicle system of claim 2, wherein said maintenance bay route further comprises an adjustment and repair area comprising:

a standby line for accommodating a redundant overhead traveling vehicle from said inter-bay route and for placing the redundant overhead traveling vehicle on standby, and an adjustment and repair line, disposed above a counter, for adjustment and repair of said overhead traveling vehicle.

6. The overhead traveling vehicle system of claim 5, wherein said operation check area further comprises an operation check buffer disposed adjacent to said operation check station.

7. The overhead traveling vehicle system of claim 5, wherein said operation check area of said maintenance bay route is disposed between said adjustment and repair area of said maintenance bay route and said inter-bay route.

8. The overhead traveling vehicle system of claim 5, wherein said adjustment and repair area further comprises a base station for adjusting said overhead traveling carriage and a base buffer adjacent to said base station.

9. The overhead traveling vehicle system of claim 5, further comprising a storage area and an adjustment and repair area disposed below said counter.

10. The overhead traveling system of claim 1, wherein said movable traveling rail is disposed in a maintenance wagon.

11. An overhead traveling vehicle system, comprising:

a fixed traveling rail comprising an inter-bay route, a plurality of intra-bay routes connected to said inter-bay route, and a maintenance bay route used for the maintenance of an overhead traveling vehicle, wherein said maintenance bay route comprises an operation check area comprising:

a loop-shaped operation check traveling line for allowing the overhead traveling vehicle to travel around said loop-shaped operation check traveling line to check traveling operation of the overhead traveling vehicle, and an operation check station for allowing the overhead traveling vehicle to transfer an article to/from said operation check station to check operation of a transfer means in the overhead traveling vehicle, and wherein said maintenance bay route further comprises an adjustment and repair area comprising:

a standby line for accommodating a redundant overhead traveling vehicle from said inter-bay route and for placing the redundant overhead traveling vehicle on standby, and an adjustment and repair line disposed above a counter for adjustment and repair of said overhead traveling carriages, and wherein an entrance and an exit of said maintenance bay route are directly connected to said inter-bay route without passing through said intra-bay routes.

12. The overhead traveling vehicle system of claim 11, wherein said operation check area of said maintenance bay route is disposed between said adjustment and repair area of said maintenance bay route and said inter-bay route.

13. The overhead traveling vehicle system of claim 12, wherein said adjustment and repair area further comprises a base station for adjusting said overhead traveling carriage and a base buffer adjacent to said base station.

14. The overhead traveling vehicle system of claim 13, further comprising a lifter having an elevatable/lowerable traveling rail connectable to said fixed traveling rail, wherein when said elevatable/lowerable traveling rail of said lifter is moved to an upper position, said elevatable/lowerable traveling rail of said lifter is connected to said maintenance bay route of fixed traveling rail, and when said elevatable/lowerable traveling rail of said lifter is moved to a lower position, said elevatable/lowerable traveling rail of said lifter is connected to at least one of a ground-mounted traveling rail and a movable traveling rail.

15. The overhead traveling system of claim 14, wherein said movable traveling rail is disposed in a maintenance wagon.

16. The overhead traveling vehicle system of claim 11, further comprising a means for storing a history file which records maintenance history for each overhead traveling vehicle, and a means for instructing said overhead traveling vehicle to travel to said maintenance bay route based on the recorded maintenance history.

17. The overhead traveling vehicle system of claim 11, further comprising a storage area and an adjustment and repair area disposed below said counter.

* * * * *